US010363755B2

(12) United States Patent
Hayashi

(10) Patent No.: US 10,363,755 B2
(45) Date of Patent: Jul. 30, 2019

(54) APPARATUS FOR AND METHOD OF PROCESSING BASE MATERIAL

(71) Applicant: SCREEN Holdings Co., Ltd., Kyoto-shi, Kyoto (JP)

(72) Inventor: Shinji Hayashi, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 15/872,787

(22) Filed: Jan. 16, 2018

(65) Prior Publication Data

US 2018/0272757 A1 Sep. 27, 2018

(30) Foreign Application Priority Data

Mar. 26, 2017 (JP) ..... 2017-060260

(51) Int. Cl.
*B41J 11/00* (2006.01)
*B65H 23/038* (2006.01)
(Continued)

(52) U.S. Cl.
CPC ..... *B41J 11/0055* (2013.01); *B41J 15/046* (2013.01); *B65H 23/0204* (2013.01);
(Continued)

(58) Field of Classification Search
CPC ..... B41J 11/0055; B41J 15/046; B65H 23/0204; B65H 23/032; B65H 23/038;
(Continued)

(56) References Cited

U.S. PATENT DOCUMENTS 5,715,071 A * 2/1998 Takashimizu ..... B65H 3/0669 271/117
2009/0278303 A1 11/2009 Fuwa
(Continued)

FOREIGN PATENT DOCUMENTS

JP 2015-13753 A 1/2015
WO 2016/181886 A1 11/2016

OTHER PUBLICATIONS

Extended European Search Report issued in corresponding EP Patent Application No. 18150221.2, dated Jul. 9, 2018.

*Primary Examiner* — Thinh H Nguyen
(74) *Attorney, Agent, or Firm* — McDermott Will & Emery LLP

(57) ABSTRACT

A base material processing apparatus includes a transport mechanism, a force detection part, a meandering prediction part, a processing part, and a controller. The transport mechanism transports an elongated strip-shaped base material in a longitudinal direction thereof along a transport path aimed by a plurality of rollers of the transport mechanism. The force detection part detects a force applied to a sensing roller in an axial direction of a rotation shaft thereof, the sensing roller being at least one of the plurality of rollers. The controller predicts the meandering state of the base material to output meandering prediction information, based on the force applied to the sensing roller in the axial direction of the rotation shaft thereof. The meandering prediction part corrects the widthwise position of the base material relative to the processing part, based on the meandering prediction information. Thus, the base material processing apparatus is capable of sensing the meandering state of the base material through the use of the existing rollers of the transport mechanism in the processing part, and is
(Continued)

capable of correcting the widthwise position of the base material relative to the processing part.

18 Claims, 7 Drawing Sheets

(51) Int. Cl.
*B41J 15/04* (2006.01)
*B65H 23/02* (2006.01)
*B65H 23/032* (2006.01)
*B65H 27/00* (2006.01)

(52) U.S. Cl.
CPC ..... *B65H 23/032* (2013.01); *B65H 23/038* (2013.01); *B65H 27/00* (2013.01); *B65H 2301/331* (2013.01); *B65H 2511/529* (2013.01); *B65H 2515/312* (2013.01); *B65H 2553/20* (2013.01); *B65H 2557/60* (2013.01); *B65H 2557/62* (2013.01)

(58) Field of Classification Search
CPC ..... B65H 2301/331; B65H 27/00; B65H 2511/529; B65H 2515/312; B65H 2553/20; B65H 2557/60; B65H 2557/62
See application file for complete search history.

(56) References Cited

U.S. PATENT DOCUMENTS

2015/0009256 A1 1/2015 Bildstein et al.
2018/0170704 A1 6/2018 Yagi et al.

* cited by examiner

APPARATUS FOR AND METHOD OF PROCESSING BASE MATERIAL

BACKGROUND OF THE INVENTION

Field of the Invention

The present invention relates to a base material processing apparatus and a base material processing method which process an elongated strip-shaped base material while transporting the base material in a longitudinal direction thereof and which further correct the meandering of the base material.

Description of the Background Art

A base material processing apparatus which performs a variety of processes on an elongated strip-shaped base material while transporting the base material in a longitudinal direction thereof by means of a plurality of rollers has heretofore been known. In such a base material processing apparatus, the base material is transported while meandering in some cases because the base material is moved out of its ideal position in a width direction thereof. There is apprehension that the occurrence of the meandering of the base material gives rise to deterioration in processing quality. To prevent this, a meandering correction apparatus for suppressing such meandering is incorporated in the base material processing apparatus.

A conventional meandering correction apparatus is disclosed, for example, in Japanese Patent Application Laid-Open No. 2015-013753. A system disclosed in Japanese Patent Application Laid-Open No. 2015-013753 measures the sidewise position of a web with high precision by means of an edge position sensor and further determines the frequency of the sidewise movement thereof. Before the web is transported to a printing processing machine, this system controls the orientation of the web, based on the determined frequency, to compensate for the sidewise movement.

However, when a meandering correction is made upstream of a processing part in the course of the transport of a base material, there is a danger that meandering occurs again before the base material is thereafter transported to the processing part. Also, when a plurality of processing heads are arranged in the direction of the transport of a base material as in a one-pass type processing apparatus, there is a danger that the meandering state of the base material is further changed when the base material passes through the processing heads respectively.

Also, when a meandering correction is made in a position near a processing part, it is difficult to ensure space for provision of a new meandering correction apparatus because an existing processing apparatus is disposed near the processing part.

SUMMARY OF THE INVENTION

It is therefore an object of the present invention to provide a technique capable of sensing and correcting the meandering state of a base material through the use of an existing transport mechanism in a processing part.

To solve the aforementioned problem, a first aspect of the present invention is intended for a base material processing apparatus comprising: a transport mechanism for transporting an elongated strip-shaped base material in a longitudinal direction thereof along a transport path formed by a plurality of rollers; a processing part for processing the base material in a processing position lying on the transport path; a force detection part for detecting a force applied in an axial direction of a rotation shaft of a sensing roller, the sensing roller being at least one of the plurality of rollers; a meandering prediction part for predicting the meandering of the base material to output meandering prediction information, based on the force applied in the axial direction of the rotation shaft of the sensing roller; and a meandering correction part for correcting the widthwise position of the base material relative to the processing part, based on the meandering prediction information.

A second aspect of the present invention is intended for a method of processing an elongated strip-shaped base material in a processing position lying on a transport path formed by a plurality of rollers while transporting the base material in a longitudinal direction thereof along the transport path. The method comprises the steps of: a) detecting a force applied in an axial direction of a rotation shaft of a sensing roller, the sensing roller being at least one of the plurality of rollers; b) predicting the meandering of the base material to output meandering prediction information, based on the force applied in the axial direction of the rotation shaft of the sensing roller; and c) correcting the widthwise position of the base material, based on the meandering prediction information.

The first and second aspects of the present invention are capable of sensing the meandering state of the base material through the use of the existing rollers positioned under the processing part, and are capable of correcting the widthwise position of the base material relative to the processing part. This achieves the processing of the base material, with the meandering of the base material corrected.

These and other objects, features, aspects and advantages of the present invention will become more apparent from the following detailed description of the present invention when taken in conjunction with the accompanying drawings.

DESCRIPTION OF THE PREFERRED EMBODIMENTS

A preferred embodiment according to the present invention will now be described with reference to the drawings. A direction in which a base material 9 is transported is referred to as a "transport direction", and a horizontal direction orthogonal to the transport direction is referred to as a "width direction" hereinafter.

<1. Configuration of Printing Apparatus>

Figure 1:
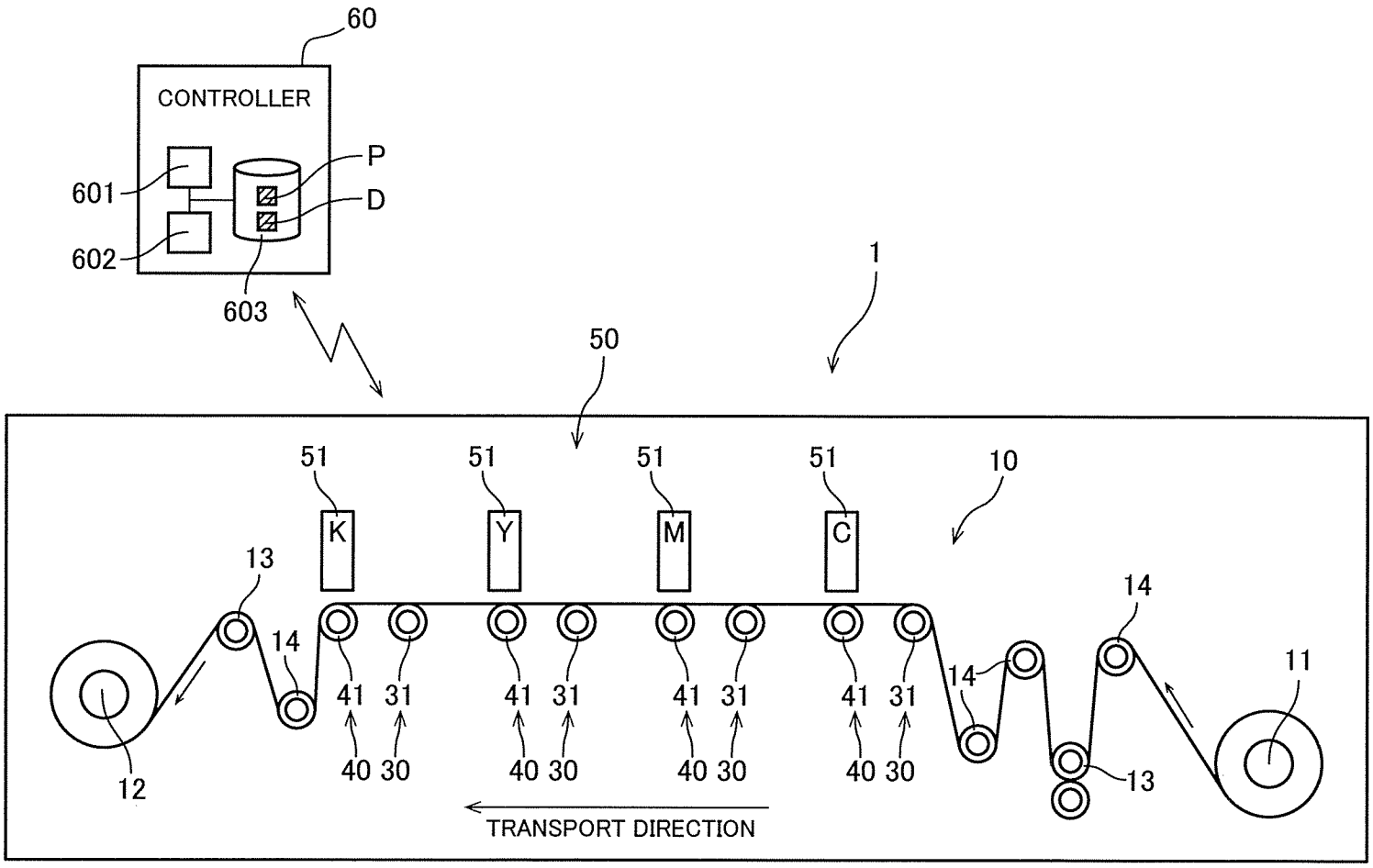
FIG. 1 is a diagram showing a configuration of a printing apparatus.

FIG. 1 is a diagram showing a configuration of a printing apparatus 1 according to one preferred embodiment of a base material processing apparatus of the present invention. This printing apparatus 1 is an apparatus which records a multi-color image on a surface of an elongated strip-shaped base material 9, based on inkjet technology, while transporting the base material 9 in a longitudinal direction thereof. For example, a film made of a synthetic resin is used as the base material 9 in the present preferred embodiment. As shown in FIG. 1, the printing apparatus 1 includes a transport mechanism 10, force detection parts 30, meandering correction parts 40, an image recording part 50, and a controller 60.

The transport mechanism 10 is a mechanism for transporting the base material 9 along a predetermined transport path. The transport mechanism 10 according to the present preferred embodiment includes an unwinder 11, a winder 12 and a plurality of transport rollers 13 and 14. A motor serving as a power source is coupled to each of the unwinder 11 and the winder 12. The transport rollers 13 and 14 include drive rollers 13 rotated automatically by the power of motors, and follower rollers 14 not coupled to any motor but rotated in accordance with the motion of the base material 9.

The transport rollers 13 and 14 constitute the transport path of the base material 9. Each of the transport rollers 13 and 14 rotates about a horizontal axis (a central axis 90 extending in the width direction) to guide the base material 9 downstream along the transport path. The base material 9 comes in contact with the transport rollers 13 and 14, so that tension T in the transport direction is applied to the base material 9.

Each of the unwinder 11, the winder 12 and the drive rollers 13 rotates when the controller 60 drives the motor coupled to each of the unwinder 11, the winder 12 and the drive rollers 13. Thus, the base material 9 is unwound from the unwinder 11 and transported via the transport rollers 13 and 14 to the winder 12.

Each of the force detection parts 30 detects a force applied to a sensing roller 31 to be described later in an axial direction of a rotation shaft thereof. The sensing roller 31 is at least one of the transport rollers 13 and 14. This force is a frictional force (reaction force) that the sensing roller 31 receives from the base material 9 when widthwise tension Tx (tension Tx in the width direction) is applied to the base material 9 due to the meandering of the base material 9. In the instance of FIG. 1, in total the four force detection parts 30 are disposed near under four respective recording heads 51 of the image recording part 50 to be described later and immediately upstream of the respective meandering correction parts 40 to be described later. However, the number of force detection parts 30 included in the printing apparatus 1 may be in the range of one to three or not less than five. An example of each of the force detection parts 30 used herein includes a mechanism for detecting a load applied to the rotation shaft of the sensing roller 31 to be described later which is one of the follower rollers 14 by means of a load cell, which will be described later in detail. The force detection parts 30 output force information Sc which is a measurement result to a frequency calculation part 63 and a meandering prediction part 64 in the controller 60 to be described later.

Each of the meandering correction parts 40 includes a mechanism for correcting the widthwise position (position as seen in the width direction) of the base material 9. In the instance of FIG. 1, in total the four meandering correction parts 40 are disposed downstream of the respective force detection parts 30, that is, under the four respective recording heads 51 of the image recording part 50 to be described later. However, the number of meandering correction parts 40 included in the printing apparatus 1 may be in the range of one to three or not less than five.

Figure 2:
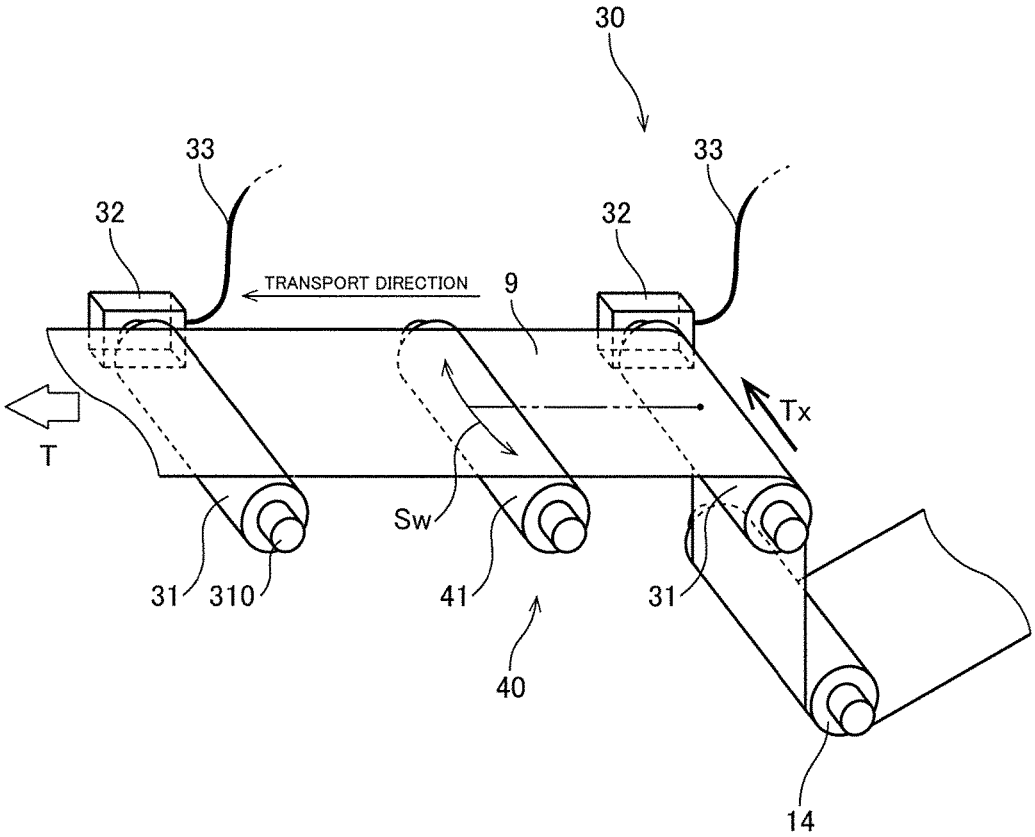
FIG. 2 is a view showing an example of a force detection part and a meandering correction part.

FIG. 2 is a view showing an example of the force detection parts 30 and the meandering correction parts 40. The meandering correction part 40 shown in FIG. 2 includes a correction roller 41. Each of the correction roller 41 and the aforementioned sensing roller 31 is at least one of the transport rollers 13 and 14 of the transport mechanism 10. While being in contact with the base material 9, the correction roller 41 and the aforementioned sensing roller 31 rotate to guide the base material 9 downstream. A moving mechanism not shown is connected to the correction roller 41. When the moving mechanism is put into operation, the correction roller 41 pivots in the width direction as indicated by an arrow Sw in FIG. 2. In this manner, the widthwise position of the base material 9 relative to the image recording part 50 is corrected by changing the position of the correction roller 41 as seen in the direction of the central axis 90 or the inclination of the correction roller 41 with respect to the central axis 90. As a result, the meandering of the base material 9 is corrected.

However, the meandering correction parts 40 according to the present invention are not limited to those having the structure shown in FIG. 2. For example, in place of or in addition to moving the position or orientation of the correction roller 41 by pivoting the correction roller 41, each of the meandering correction parts 40 may be configured to move the position or orientation of a corresponding one of the recording heads 51 of the image recording part 50 to be described later to correct the widthwise position of the base material 9 relative to the corresponding one of the recording heads 51.

The image recording part 50 includes a mechanism for ejecting ink droplets toward the base material 9 transported by the transport mechanism 10. The image recording part 50 is an example of a "processing part" in the present invention. In the instance of FIG. 1, the image recording part 50 is disposed downstream of the unwinder 11 and upstream of the winder 12 as seen along the transport path.

The image recording part 50 according to the present preferred embodiment includes the four recording heads 51. The four recording heads 51 are disposed over the transport path of the base material 9 and spaced apart from each other in the transport direction. Each of the recording heads 51 includes ejection orifices arranged parallel to the width direction of the base material 9. The four recording heads 51 eject ink droplets of four respective colors, i.e. cyan (C), magenta (M), yellow (Y) and black (K) respectively, which serve as color components of a multi-color image from the ejection orifices toward an upper surface of the base material 9. Thus, the multi-color image is recorded on the upper surface of the base material 9.

The image recording part 50 according to the present preferred embodiment is what is called a one-pass type recording part. That is, the four recording heads 51 do not move back and forth in the width direction. The image recording part 50 records a multi-color image on the upper surface of the base material 9 by ejecting ink droplets from the recording heads 51 while the base material 9 passes under the recording heads 51 only once.

Figure 3:
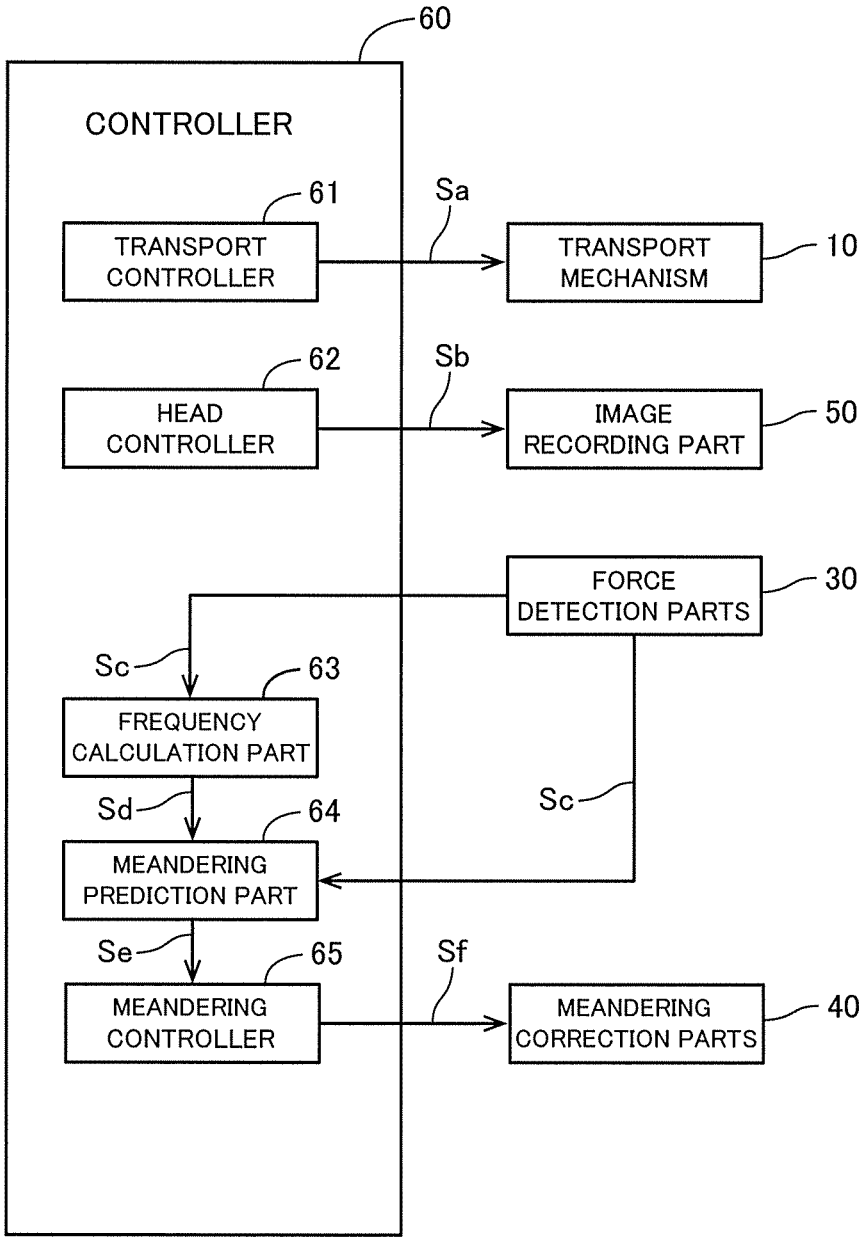
FIG. 3 is a block diagram showing connections between a controller and components in the printing apparatus.

The controller 60 controls the operations of the components in the printing apparatus 1. As conceptually shown in FIG. 1, the controller 60 is formed by a computer including an arithmetic processor 601 such as a CPU, a memory 602 such as a RAM, and a storage part 603 such as a hard disk drive. FIG. 3 is a block diagram showing connections between the controller 60 and the components in the printing apparatus 1. As shown in FIG. 3, the controller 60 is connected to the transport mechanism 10, the force detection parts 30, the meandering correction parts 40 and the image recording part 50 mentioned above respectively for communication therewith.

The controller 60 temporarily reads a computer program P and data D that are stored in the storage part 603 onto the memory 602. The arithmetic processor 601 performs arithmetic processing based on the computer program P and the data D, so that the controller 60 controls the operations of the components in the printing apparatus 1. Thus, the printing process in the printing apparatus 1 and the process of sensing and correcting the meandering state of the base material 9 to be described later proceed.

As conceptually shown in FIG. 3, the controller 60 includes a transport controller 61, a head controller 62, the frequency calculation part 63, the meandering prediction part 64, and a meandering controller 65. The computer serving as the controller 60 operates in accordance with the computer program P, whereby the functions of these parts 61 to 65 are implemented.

The transport controller 61 controls the operation of transporting the base material 9 by means of the transport mechanism 10. Specifically, the transport controller 61 outputs a driving instruction signal Sa to the motors respectively connected to the unwinder 11, the winder 12 and the drive rollers 13. This drives each of the motors at specified rpm (the number of revolutions). When the motors are driven, the unwinder 11, the winder 12 and the drive rollers 13 rotate to transport the base material 9 along the transport path.

The head controller 62 controls the operation of ejecting ink droplets in each of the four recording heads 51. Based on submitted image data, the head controller 62 outputs an ejection instruction signal Sb to the four recording heads 51. The ejection instruction signal Sb includes information indicating nozzles from which the ink droplets are to be ejected, the size of the ink droplets, and the ejection timing of the ink droplets. Each of the recording heads 51 ejects the ink droplets having the size specified by the ejection instruction signal Sb from the nozzles specified by the ejection instruction signal Sb according to the timing specified by the ejection instruction signal Sb. Thus, a multi-color image corresponding to the image data is formed on the upper surface of the base material 9.

The frequency calculation part 63 calculates the frequency of increase and decrease in frictional force (reaction force) that the sensing roller 31 receives from the base material 9 in the axial direction of the rotation shaft thereof due to the meandering of the base material 9 transported by the transport mechanism 10. As mentioned above, the force detection parts 30 output the force information Sc which is the measurement result to the frequency calculation part 63. Based on the force information Sc measured by the force detection parts 30, the frequency calculation part 63 calculates the frequency of the frictional force (reaction force) applied to the sensing roller 31. Then, the frequency calculation part 63 outputs frequency information Sd indicative of the calculation result to the meandering prediction part 64.

The meandering prediction part 64 predicts meandering that will occur in the base material 9 transported by the transport mechanism 10. As mentioned above, the force detection parts 30 further output the force information Sc which is the measurement result to the meandering prediction part 64. The frequency calculation part 63 outputs the frequency information Sd which is the calculation result to the meandering prediction part 64. Based on the force information Sc measured by the force detection parts 30 and the frequency information Sd calculated by the frequency calculation part 63, the meandering prediction part 64 calculates the amount of meandering already occurring in the base material 9 and predicts the meandering that will occur thereafter in the base material 9. Specifically, the meandering prediction part 64 predicts the amount of widthwise displacement of a location of the base material 9 which will come into contact with the correction roller 41 positioned under the image recording part 50. Then, the meandering prediction part 64 outputs meandering prediction information Se indicative of a prediction result to the meandering controller 65.

The meandering controller 65 controls the operation of the meandering correction parts 40. Based on the meandering prediction information Se provided from the meandering prediction part 64, the meandering controller 65 calculates a correction amount in the meandering correction parts 40. Then, the meandering controller 65 outputs a correction instruction signal Sf indicative of the calculated correction amount to the meandering correction parts 40. Based on the correction instruction signal Sf, each of the meandering correction parts 40 pivots the correction roller 41. Thus, the widthwise position of the base material 9 is corrected. As a result, the meandering of the base material 9 is corrected.

In this manner, the printing apparatus 1 includes a meandering correction apparatus including the transport mechanism 10, the force detection parts 30, the meandering correction parts 40, and the controller 60.

<2. Sensing and Correction of Meandering>

Next, the sensing and correction of meandering in the printing apparatus 1 will be described in further detail.

Figure 4:
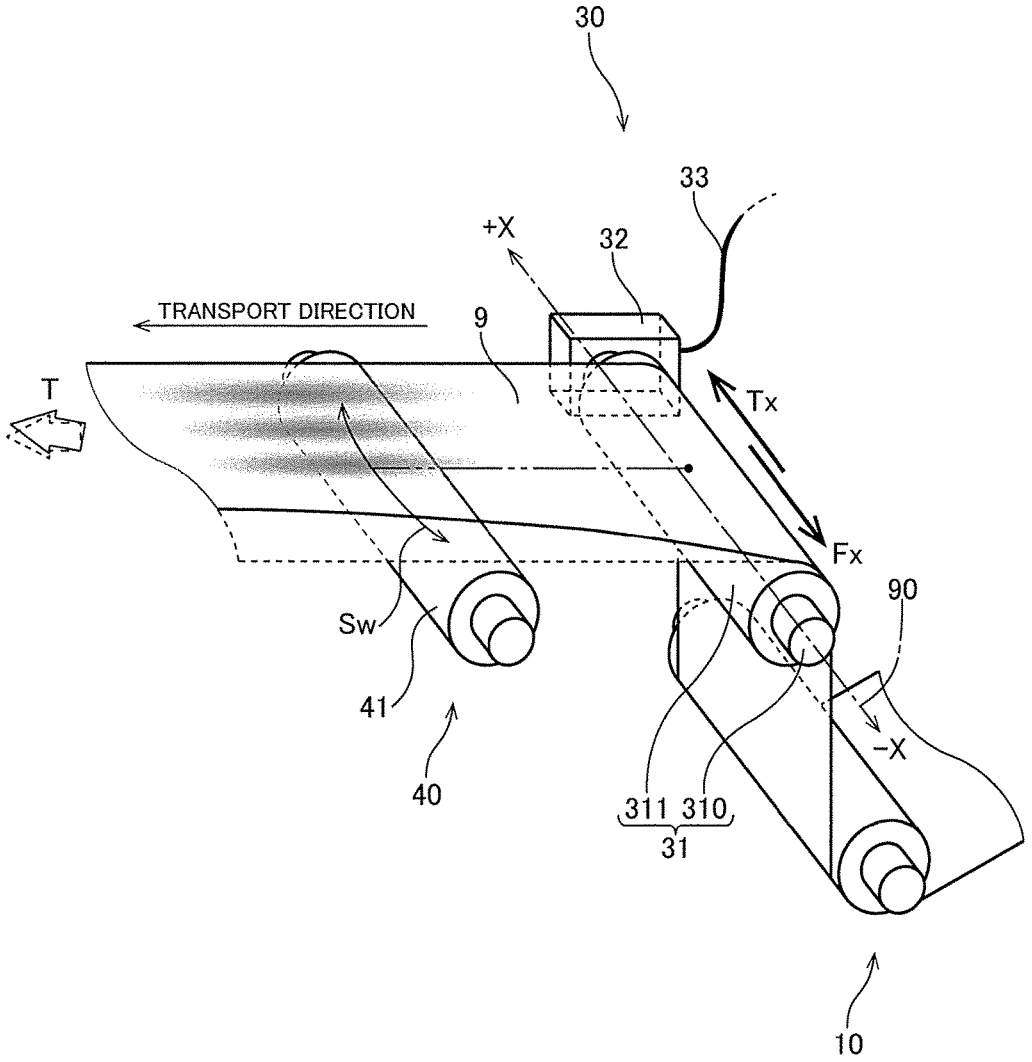
FIG. 4 is a view conceptually showing a relationship between axial tension applied to a base material and a frictional force received from a sensing roller.

FIG. 4 is a view conceptually showing a relationship between the tension Tx applied in the direction of the central axis 90 to the base material 9 and a frictional force Fx received from the sensing roller 31 when meandering occurs in the base material 9 transported by the transport mechanism 10. As shown in FIG. 4, each of the force detection parts 30 includes the sensing roller 31 and a load cell 32.

The sensing roller 31 is positioned near under the image recording part 50 and immediately upstream of each correction roller 41. The sensing roller 31 includes a rotation shaft 310 and a roller portion 311. The rotation shaft 310 is fixed to a housing or the like constituting the printing apparatus 1, and is relatively stationary. The roller portion 311 is supported rotatably about the central axis 90 extending in the width direction with respect to the rotation shaft 310 through a bearing portion. For example, metal such as aluminum and stainless steel is used as the material of the rotation shaft 310. The sensing roller 31 may have another structure, which will be described later in a modification.

The load cell 32 has a structure such that a strain sensor is fixed by bonding to a deformable strain body, for example. The load cell 32 is disposed adjacent to at least one end of the rotation shaft 310 of the sensing roller 31. In addition the load cell 32 has a deformable free end fixed to the rotation shaft 310 of the sensing roller 31. For example, metal such as aluminum and stainless steel is used as the material of the load cell 32. This provides a correct amount of displacement in accordance with a load when the load is applied to the load cell 32. A magnetostrictive load cell, a capacitive load cell or the like may be used as the load cell 32 in place of the strain sensor load cell.

A force detection and output part including a circuit board is further mounted on the load cell 32. The circuit board is electrically connected to the strain sensor of the load cell 32. A wire 33 for electrical connection to the force detection and output part further extends outwardly from the load cell 32 and is connected to the controller 60.

When the rotation shaft 310 of the sensing roller 31 is displaced in the direction of the central axis 90, the strain body and the strain sensor of the load cell 32 fixed to and adjacent to the one end of the rotation shaft 310 of the sensing roller 31 are displaced. Thus, an output from the strain sensor of the load cell 32 is varied.

Figure 5:
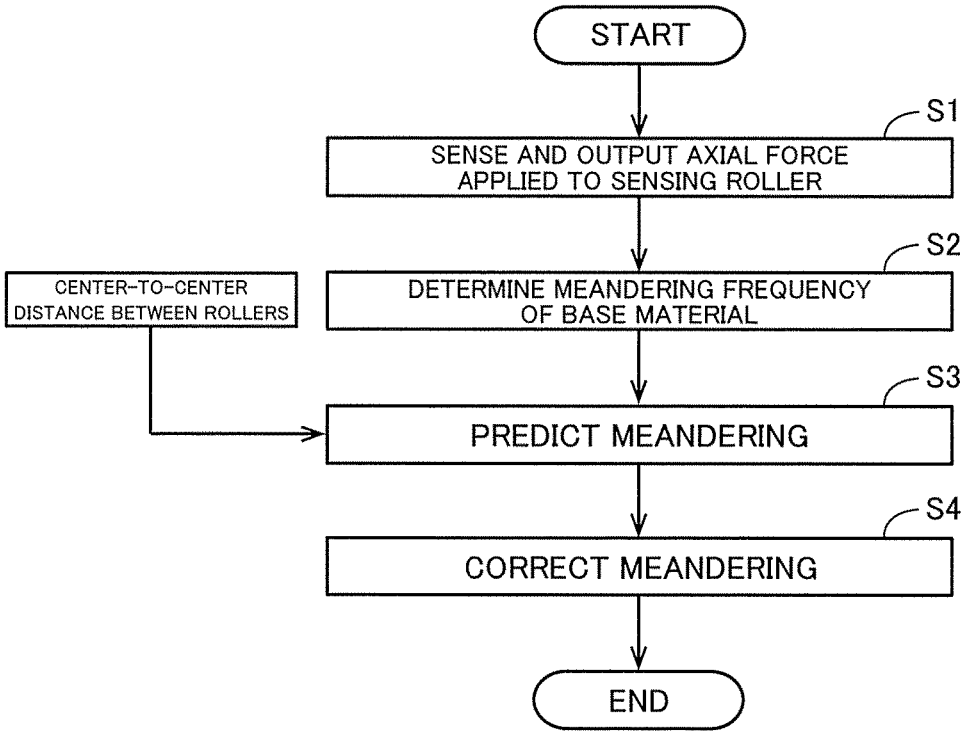
FIG. 5 is a flow diagram showing a procedure for the process of sensing and correcting meandering.

FIG. 5 is a flow diagram showing a procedure for the process of sensing and correcting meandering in the printing apparatus 1. In this printing apparatus 1, the meandering sensing and correction process shown in FIG. 5 is repeatedly performed consecutively, intermittently or at predetermined time intervals when the base material 9 is transported near under each of the recording heads 51 of the image recording part 50. The steps in the flow diagram will be described below. Some parts similar to those described above will not be discussed.

An instance in which meandering occurs in the base material 9 transported by the transport mechanism 10 will be described on the assumption that the base material 9 is shifted closer to one side of the sensing roller 31 as seen in the width direction, e.g. closer to the positive X side of the sensing roller 31 as seen in FIG. 4. As mentioned above, the tension T in the transport direction is always applied to the base material 9 by the contact of the base material 9 with the transport rollers 13 and 14 when the base material 9 is transported by the transport mechanism 10. However, the tension T applied to the base material 9 in a location where meandering occurs in the base material 9 is inclined in the positive X direction. Thus, the tension Tx that is a component of the tension T in the positive X direction is caused in the base material 9.

With reference to FIG. 4, the base material 9 remains unsliding further in the width direction while being in contact with the sensing roller 31. This is because the base material 9 is subjected to the frictional force Fx from the sensing roller 31 in addition to the tension Tx as the forces in the width direction. The sensing roller 31 is subjected to the frictional force (reaction force) having the same magnitude and the same direction as the tension Tx from the base material 9. Thus, the sensing roller 31 and the load cell 32 fixed to the sensing roller 31 are displaced in the direction of the central axis 90.

In the load cell 32, an output from the strain sensor reaches the force detection and output part through the circuit board, as mentioned above. The displacement of the load cell 32 in the direction of the central axis 90 causes the output from the strain sensor to vary. The force detection and output part acquires a detection signal which is the output from the strain sensor, and calculates the aforementioned frictional force (reaction force) applied to the sensing roller 31 indicated by the detection signal, i.e. a force applied in the axial direction of the rotation shaft 310.

The force information Sc about the force applied in the axial direction of the rotation shaft 310 to the sensing roller 31 which is calculated by the force detection and output part is outputted through the wire 33 to the frequency calculation part 63 and the meandering prediction part 64 of the controller 60 to be described later (Step S1).

Subsequently, the frequency calculation part 63 determines the frequency (meandering frequency of the base material 9) of the force applied in the axial direction of the rotation shaft 310 to the sensing roller 31 due to the meandering of the base material 9 transported by the transport mechanism 10, based on the force applied to the sensing roller 31 in the axial direction of the rotation shaft 310 according to the force information Sc (Step S2). The meandering frequency refers to a frequency at which the base material 9 is periodically displaced in the width direction. Determining the period of the widthwise displacement of the base material 9 leads to the prediction of meandering which will subsequently occur in the base material 9. The frequency calculation part 63 outputs the determined frequency information Sd on the base material 9 to the meandering prediction part 64.

Subsequently, the meandering prediction part 64 calculates the amount of meandering already occurring in the base material 9 and predicts meandering which will subsequently occur in the base material 9 without any meandering correction, based on the force applied in the axial direction of the rotation shaft 310 to the sensing roller 31 which is calculated in the force detection parts 30 and the meandering frequency of the base material 9 which is determined in the frequency calculation part 63 (Step S3). In this step, consideration is given to the center-to-center distance as measured in the transport direction between the sensing roller 31 for which the aforementioned force applied in the axial direction of the rotation shaft 310 is measured and the correction roller 41 positioned immediately downstream of the sensing roller 31 along the transport path and under the image recording part 50. Then, the meandering prediction part 64 predicts the amount of widthwise displacement in a location of the base material 9 which will come into contact with the correction roller 41 without any meandering correction. The meandering prediction part 64 outputs the meandering prediction information Se indicative of the prediction result to the meandering controller 65.

Further, the meandering controller 65 controls the operation of the meandering correction parts 40, based on the meandering prediction information Se provided from the meandering prediction part 64 (Step S4). In this step, the meandering controller 65 calculates the correction amount so as to cancel out the meandering predicted in the meandering prediction information Se. Then, the meandering controller 65 outputs the correction instruction signal Sf indicative of the calculated correction amount to the meandering correction parts 40. Each of the meandering correction parts 40 pivots the correction roller 41, based on the correction instruction signal Sf. Thus, the widthwise position of the base material 9 relative to the image recording part 50 is corrected. As a result, the meandering of the base material 9 is corrected.

In this manner, the correction instruction signal Sf is preferably calculated so as to cancel the widthwise misregistration of the base material 9 under each of the recording heads 51 of the image recording part 50. In other words, it is preferable that the process such as printing is performed on the base material 9 while the meandering of the base material 9 is predicted in the sensing roller 31 positioned immediately upstream of the correction roller 41 positioned under each of the recording heads 51 of the image recording part 50 and is corrected in the correction roller 41 immediately downstream of the sensing roller 31 respectively. At this time, the correction amount is preferably determined so that the widthwise position of the base material 9 approaches an ideal position under each of the recording heads 51 in consideration of the first order lag characteristics of the meandering correction.

As described above, the printing apparatus 1 is capable of sensing and correcting the meandering state of the base material 9 by means of the existing transport rollers 13 and 14 positioned under the image recording part 50. Thus, the meandering state of the base material 9 is sensed and corrected even near the image recording part 50 where it is difficult to ensure space for provision of a new meandering correction apparatus. Also, the widthwise position of the base material 9 is corrected immediately under the image recording part 50. This allows the recording of a multi-color image on the upper surface of the base material 9 before meandering occurs again after the correction of meandering. Thus, printing quality is improved.

A conventional edge sensor generally used for the detection of the meandering of the base material 9 detects irregularities, if any, in the shape of edges of the base material 9 as meandering. In this case, the meandering correction parts make an unwanted correction, based on the shape of the edges of the base material 9. However, the printing apparatus 1 senses and corrects the meandering of the base material 9, based on the widthwise tension Tx of the base material 9. This prevents the unwanted meandering correction resulting from the shape of the edges of the base material 9.

<3. Modifications>

While the one preferred embodiment according to the present invention has been described hereinabove, the present invention is not limited to the aforementioned preferred embodiment.

In the aforementioned preferred embodiment, the meandering correction parts 40 are disposed under the four respective recording heads 51 of the image recording part 50, and the force detection parts 30 are positioned immediately upstream of the respective meandering correction parts 40. However, the positions of the meandering correction parts 40 and the force detection parts 30 are not limited to these positions. In particular, the force detection parts 30 may be positioned, for example, downstream of the image recording part 50 along the transport path. In this case, the meandering state of the base material 9 under the image recording part 50 may be predicted and corrected, based on the force applied in the axial direction of the rotation shaft 310 to the sensing roller 31 provided downstream of the image recording part 50 along the transport path and the like.

The sensing roller 31 of each of the force detection parts 30 and the correction roller 41 of each of the meandering correction parts 40 may be the same roller. For example, the meandering state of the base material 9 in the position of this roller may be sensed based on the force applied in the axial direction of the rotation shaft of this roller to this roller positioned immediately under each of the recording heads 51 of the image recording part 50, and the widthwise position of the base material 9 relative to the image recording part 50 in that position may be corrected by pivoting this roller in the width direction.

Figure 6:
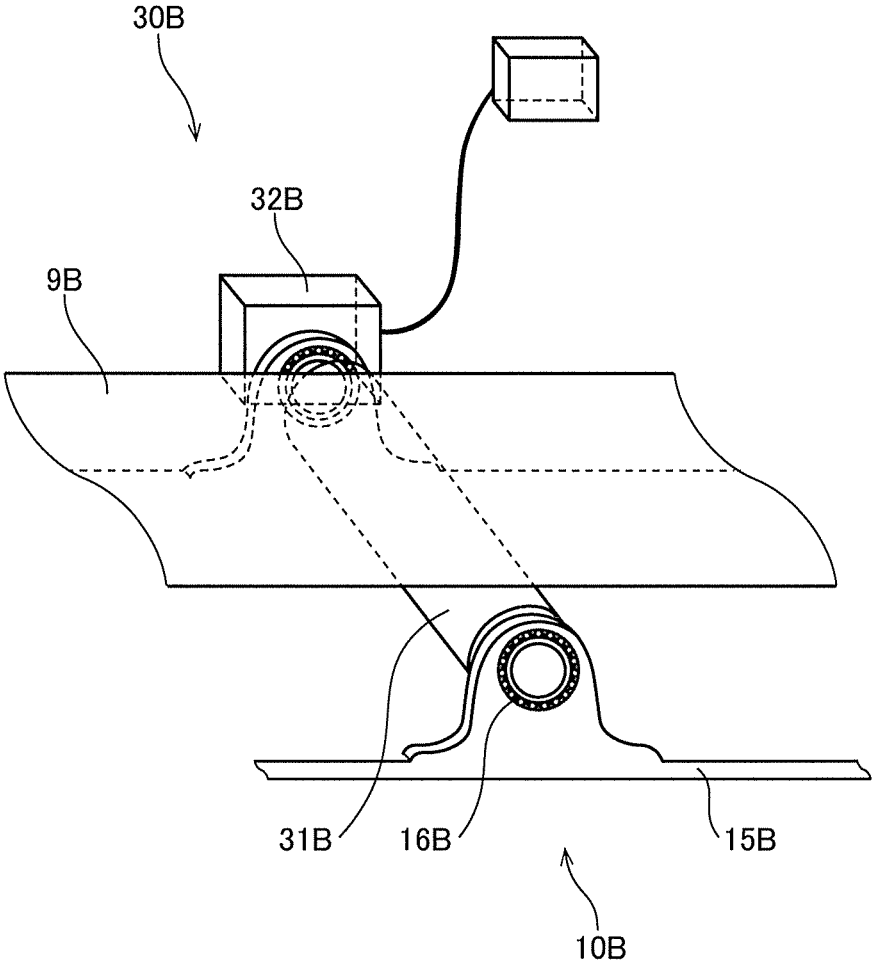
FIG. 6 is a view showing a structure of the force detection part according to a modification.

FIG. 6 is a view showing a structure of a force detection part 30B according to a modification. In the modification of FIG. 6, a transport mechanism 10B for transporting a base material 9B includes a body frame 15B, a plurality of transport rollers including a sensing roller 31B, and additionally at least one bearing portion 16B. The at least one bearing portion 16B is directly or indirectly fixed to the body frame 15B, and rotatably supports the transport rollers including the sensing roller 31B respectively. The force detection part 30B includes a load cell 32B having a deformable free end fixed to the bearing portion 16B. Such a structure is also capable of detecting the force applied in the axial direction of the rotation shaft of the sensing roller 31B.

Figure 7:
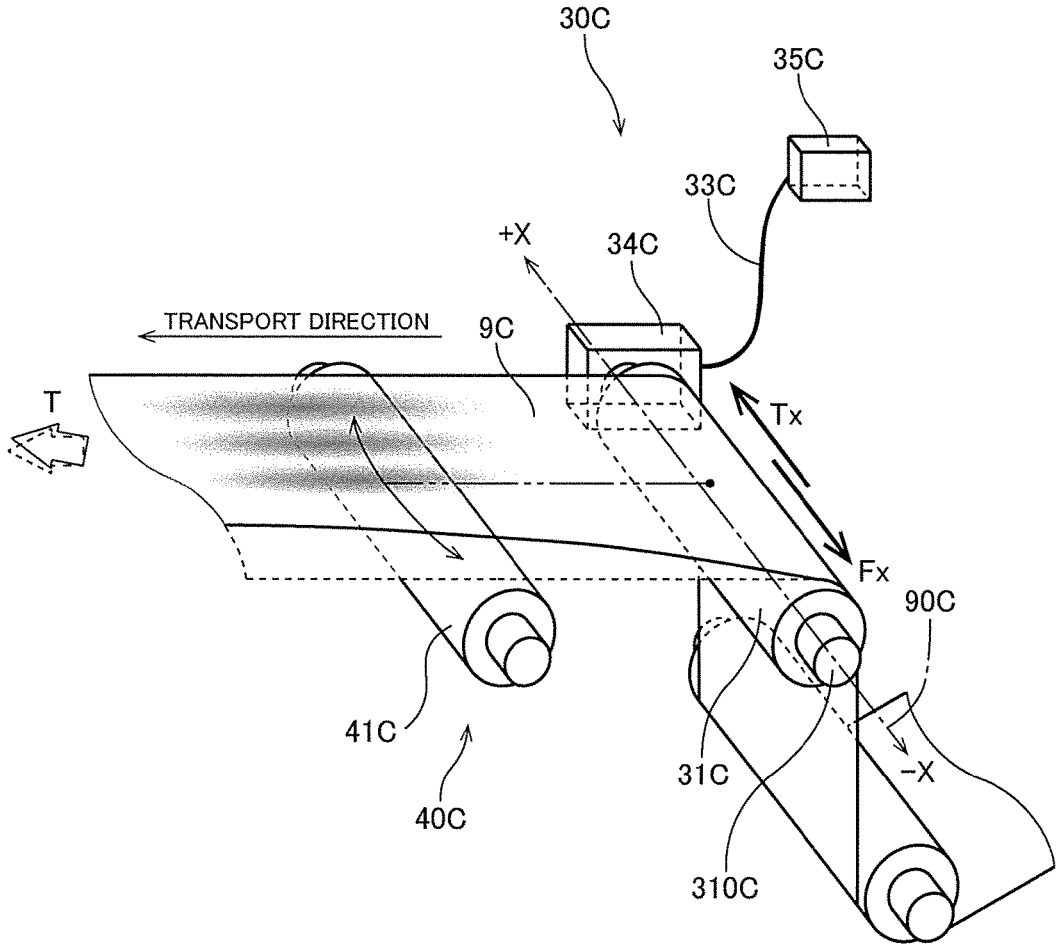
FIG. 7 is a view showing a structure of the force detection part and the meandering correction part according to another modification.

FIG. 7 is a view showing a structure of a force detection part 30C and a meandering correction part 40C according to another modification. In the modification of FIG. 7, the force detection part 30C includes a sensing roller 31C, a displacement sensor 34C, and an axial force calculation part 35C.

The sensing roller 31C is positioned near under an image recording part and immediately upstream of each correction roller 41C. An strain body deformable in the direction of a central axis 90C is used as the material of a rotation shaft 310C of the sensing roller 31C. This provides a correct amount of displacement in accordance with a load in the direction of the central axis 90C when the load is applied to the rotation shaft 310C of the sensing roller 31C.

The displacement sensor 34C includes a strain gauge fixed by bonding to the rotation shaft 310C of the sensing roller 31C, and a circuit board. The circuit board is electrically connected to the strain gauge. A wire 33C electrically connected to the circuit board further extends outwardly from the displacement sensor 34C, and is connected to the axial force calculation part 35C. The displacement sensor 34C is only required to be able to detect the displacement in the axial direction of the rotation shaft 310C of the sensing roller 31C, and may have a structure different from that of this modification. For example, the displacement sensor 34C may be a capacitive sensor, a sensor using a spring, a sensor using a compression element and the like.

When the rotation shaft 310C of the sensing roller 31C is displaced in the direction of the central axis 90C due to the meandering of a base material 9C, the strain gauge fixed to the rotation shaft 310C of the sensing roller 31C is displaced. This causes an output from the strain gauge to vary. The output from the strain gauge reaches the axial force calculation part 35C through the circuit board of the displacement sensor 34C and the wire 33C. The axial force calculation part 35C acquires a detection signal which is an output from the displacement sensor 34C, and calculates the force applied to the rotation shaft 310C of the sensing roller 31C indicated by the detection signal. Such a structure is also capable of detecting the force applied in the axial direction of the rotation shaft 310C of the sensing roller 31C.

In the aforementioned preferred embodiment, edge sensors are completely eliminated from the printing apparatus. However, an apparatus (e.g., EPC® (Edge Position Control or the like) including a conventional edge sensor may be used together as the meandering correction apparatus in the printing apparatus according to the present invention. Specifically, the meandering of the base material may be corrected in consideration of both the position of the edges of the base material measured by the edge sensor and the meandering of the base material predicted from the tension applied to the base material.

The image recording part according to the aforementioned preferred embodiment includes the four recording heads. However, the number of recording heads in the image recording part may be in the range of one to three or not less than five. For example, the image recording part may further include a recording head for ejecting an ink of a spot color in addition to the four recording heads for ejecting inks of C, M, Y and K.

A film is used as the base material 9 in the aforementioned preferred embodiment. However, the base material to be subjected to the meandering correction in the present invention is not limited to films but may include base materials made of other materials such as paper.

The printing apparatus which ejects ink toward the surface of the base material has been described in the aforementioned preferred embodiment. That is, the image recording part 50 serving as a processing part supplies the ink serving as a processing material to the base material 9 in the form of processing in the aforementioned preferred embodiment. However, the base material processing apparatus according to the present invention may include a processing part which supplies a processing material (e.g., resist solutions, various coating materials and the like) other than the ink to the surface of the base material in a processing position lying on the transport path. Alternatively, the base material processing apparatus according to the present invention may perform processing (e.g., exposure to light for the formation of a pattern, drawing using laser and the like) other than the supply of the processing material to the base material on the transport path of the base material.

The components described in the aforementioned preferred embodiment and in the modifications may be consistently combined together, as appropriate.

While the invention has been described in detail, the foregoing description is in all aspects illustrative and not restrictive. It is understood that numerous other modifications and variations can be devised without departing from the scope of the invention.

What is claimed is:

1. A base material processing apparatus comprising:

a transport mechanism for transporting an elongated strip-shaped base material in a longitudinal direction thereof along a transport path formed by a plurality of rollers;

a processing part for processing said base material in a processing position lying on said transport path;

a force detection part for detecting a force applied in an axial direction of a rotation shaft of a sensing roller, said sensing roller being at least one of said plurality of rollers;

a meandering prediction part for predicting meandering of said base material to output meandering prediction information, based on the force applied in the axial direction of the rotation shaft of said sensing roller; and a meandering correction part for correcting a widthwise position of said base material relative to said processing part, based on said meandering prediction information.

2. The base material processing apparatus according to claim 1, wherein said sensing roller is positioned under said processing part.

3. The base material processing apparatus according to claim 1, wherein said meandering correction part moves a position or orientation of a correction roller to thereby correct the widthwise position of said base material relative to said processing part, said correction roller being at least one of said plurality of rollers.

4. The base material processing apparatus according to claim 3, wherein said correction roller is positioned under said processing part.

5. The base material processing apparatus according to claim 3, wherein said correction roller is positioned downstream of said sensing roller along said transport path.

6. The base material processing apparatus according to claim 1, further comprising a frequency calculation part for calculating frequency of increase and decrease in the force applied in the axial direction of the rotation shaft of said sensing roller, based on the force applied in the axial direction of the rotation shaft of said sensing roller, wherein said meandering prediction part predicts the meandering of said base material to output said meandering prediction information, based on said frequency.

7. The base material processing apparatus according to claim 1, wherein said force detection part includes a load cell, and said load cell is fixed to said sensing roller.

8. The base material processing apparatus according to claim 1, wherein:

said force detection part includes a load cell;

said transport mechanism includes a body, said plurality of rollers, and at least one bearing portion directly or indirectly fixed to said body and rotatably supporting said plurality of rollers respectively; and said load cell is fixed to said bearing portion.

9. The base material processing apparatus according to claim 1, wherein said processing part supplies a processing material to a surface of said base material.

10. The base material processing apparatus according to claim 1, wherein the force detection part detects the force in the axial direction to be applied to the sensing roller from the base material.

11. A method of processing an elongated strip-shaped base material in a processing position lying on a transport path formed by a plurality of rollers while transporting said base material in a longitudinal direction thereof along said transport path, said method comprising the steps of:

a) detecting a force applied in an axial direction of a rotation shaft of a sensing roller, said sensing roller being at least one of said plurality of rollers;

b) predicting meandering of said base material to output meandering prediction information, based on the force applied in the axial direction of the rotation shaft of said sensing roller; and c) correcting a widthwise position of said base material, based on said meandering prediction information.

12. The method according to claim 11, further comprising the step of supplying a processing material to a surface of said base material in said processing position.

13. The method according to claim 11, wherein the widthwise position of said base material is corrected under said processing position in said step c).

14. The method according to claim 11, wherein the force applied in the axial direction of the rotation shaft of said sensing roller is detected under said processing position in said step a).

15. The method according to claim 11, wherein the widthwise position of said base material is corrected in said step c) by moving a position or orientation of a correction roller, said correction roller being at least one of said plurality of rollers.

16. The method according to claim 11, wherein the widthwise position of said base material is corrected in a position downstream of said sensing roller along said transport path in said step c).

17. The method according to claim 11, wherein said step b) consists of the steps of:

calculating frequency of increase and decrease in the force applied in the axial direction of the rotation shaft of said sensing roller, based on the force applied in the axial direction of the rotation shaft of said sensing roller; and predicting the meandering of said base material to output said meandering prediction information, based on said frequency.

18. The method according to claim 11, wherein the step a) detects the force in the axial direction to be applied to the sensing roller from the base material.

* * * * *